US009914622B2

(12) United States Patent
Valjus et al.

(10) Patent No.: US 9,914,622 B2
(45) Date of Patent: Mar. 13, 2018

(54) ELEVATOR SUSPENSION AND COMPENSATING ROPES

(71) Applicant: KONE Corporation, Helsinki (FI)

(72) Inventors: Petteri Valjus, Helsinki (FI); Raimo Pelto-Huikko, Vantaa (FI)

(73) Assignee: KONE CORPORATION, Helsinki (FI)

( * ) Notice: Subject to any disclaimer, the term of this patent is extended or adjusted under 35 U.S.C. 154(b) by 4 days.

(21) Appl. No.: 14/107,835

(22) Filed: Dec. 16, 2013

(65) Prior Publication Data

US 2014/0182976 A1 Jul. 3, 2014

(30) Foreign Application Priority Data

Dec. 27, 2012 (EP) ..... 12199385

(51) Int. Cl.

| | |
|---|---|
| ***B66B 7/06*** | (2006.01) |
| ***B66B 11/08*** | (2006.01) |
| ***B66B 7/10*** | (2006.01) |
| ***B66B 11/00*** | (2006.01) |

(52) U.S. Cl.

CPC ..... *B66B 11/008* (2013.01); *B66B 7/062* (2013.01); *B66B 7/10* (2013.01); *B66B 11/0065* (2013.01); *D07B 2501/2007* (2013.01)

(58) Field of Classification Search

CPC ..... B66B 7/068; B66B 7/062; B66B 7/10
USPC ..... 187/264, 357; 74/89.22
See application file for complete search history.

(56) References Cited

U.S. PATENT DOCUMENTS 2,270,441 A * 1/1942 Hymans ..... B66B 7/068 187/264
2,537,075 A * 1/1951 Margles ..... B66B 7/068 187/264
3,014,699 A * 12/1961 Bentley ..... 254/392
3,653,467 A * 4/1972 Showalter ..... B66B 7/068 187/265

(Continued)

FOREIGN PATENT DOCUMENTS

CN 1277281 A1 12/2000
CN 1331768 A 1/2002

(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator includes an elevator car and a counterweight; a first roping between the elevator car and counterweight and including at least one rope; a second roping between the elevator car and counterweight and including at least one rope; and a rope wheel arrangement, having at least one rope wheel, around which the at least one rope of the second roping passes. The longitudinal force transmission capability of the at least one rope of the second roping is based essentially on non-metallic fibers and is a belt-like rope having at least one contoured side provided with guide rib(s) and/or guide groove(s) oriented in the longitudinal direction of the rope, the side being fitted to pass against a contoured circumference of a rope wheel of the rope wheel arrangement, the circumference being provided with guide rib(s) and/or guide groove(s) so as to form a counterpart for the contoured side of the rope.

16 Claims, 3 Drawing Sheets

(56) References Cited

U.S. PATENT DOCUMENTS

| | | | | |
|---|---|---|---|---|
| 3,882,968 | A | 5/1975 | Suozzo | |
| 5,788,018 | A * | 8/1998 | Mendelsohn et al. | 187/266 |
| 6,364,061 | B2 * | 4/2002 | Baranda et al. | 187/254 |
| 6,364,063 | B1 * | 4/2002 | Aulanko et al. | 187/254 |
| 6,386,324 | B1 | 5/2002 | Baranda et al. | |
| 6,508,051 | B1 | 1/2003 | De Angelis | |
| 8,602,174 | B2 | 12/2013 | Aulanko | |
| 2001/0025743 | A1 * | 10/2001 | Ach | 187/264 |
| 2004/0079590 | A1 * | 4/2004 | Sweet | 187/254 |
| 2004/0206579 | A1 * | 10/2004 | Baranda et al. | 187/254 |
| 2008/0223664 | A1 * | 9/2008 | Johansson et al. | 187/254 |
| 2008/0223665 | A1 * | 9/2008 | O'Donnell | 187/256 |
| 2011/0000746 | A1 * | 1/2011 | Pelto-Huikko et al. | 187/254 |
| 2011/0088980 | A1 * | 4/2011 | Husmann | 187/249 |
| 2011/0266097 | A1 * | 11/2011 | Valjus et al. | 187/254 |
| 2012/0329591 | A1 | 12/2012 | Goeser et al. | |

FOREIGN PATENT DOCUMENTS

| | | | |
|---|---|---|---|
| CN | 1886322 | A | 12/2006 |
| DE | 102010016872 | A1 | 11/2011 |
| EP | 1396458 | A2 * | 3/2004 |
| WO | WO 2009/090299 | A1 | 7/2009 |
| WO | WO 2011/055020 | A1 | 5/2011 |
| WO | WO 2011/128223 | A2 | 10/2011 |
| WO | WO 2011/135174 | A1 | 11/2011 |

* cited by examiner

ELEVATOR SUSPENSION AND COMPENSATING ROPES

FIELD OF THE INVENTION

The invention relates to an elevator. The elevator is particularly meant for transporting passengers and/or goods.

BACKGROUND OF THE INVENTION

Elevators typically have a suspension roping between the elevator car and the counterweight which roping passes around a rope wheel mounted stationary in some suitable position above said elevator units. Additionally, the elevator may need to be provided with another roping (later referred to as a second roping) between the elevator car and the counterweight suspended to hang from the elevator car and the counterweight. This type of arrangement is normally used to provide compensation for the weight of the hoisting roping. Particularly, in this way the unbalance caused by the hoisting roping and occurring when the elevator car is run to its extreme position can be eliminated. In this case, the second roping can hang freely in the shaft and no rope wheel is necessary to guide it. The second roping may also be used to provide a tie-down-function (also known as lock-down function). This function is obtained by arranging the second roping to pass around a rope wheel mounted stationary in some suitable position below said elevator units, for instance at the lower end of the shaft. The radially directed movement this rope wheel is blocked and therefore it can produce a support force for the loop of the second roping so it restrict the elevator car from continuing its upwards directed movement (jumping) in case the counterweight suddenly stops, and vice versa. These types of incidents would be harmful and dangerous, because they might cause displacement of the suspension ropes. Sudden jerks might also be caused for the people inside the car.

Normally, the cross-sectional shape, type and number of the ropes of the hoisting roping and the second roping are similar. Also, if these ropings are guided, they are normally guided mutually in the same way by their rope wheels. The similarity provides that same ropes can be used both in the hoisting roping and the second roping. Also, in this way complete compensation is attained as the weights of the hoisting roping and second roping are automatically similar.

Normally, the elevator ropes are metallic. Metallic ropes have the drawback that they are heavy, which causes several challenges, for instance in energy consumption and dimensioning. It has been attempted to utilize a light-weighted roping in cases where the second roping need not be heavy due to purpose or compensation. In this case, each rope of the second roping may be such that its longitudinal force transmission capability is based essentially on non-metallic fibers, for instance. This kind of a rope with light-weighted force transmission part (i.e. load bearing member) is known as such for instance in WO2009090299A1. It has been found out that if the ropes of the second roping are light-weighted and belt-like they may occasionally take strong disturbance from air flows occurring in the hoistway. Especially elevators with long lifting height, and therefore with long free rope spans, are detected to be prone to this problem. The disturbance may cause unintended horizontal movement (e.g. sway) in the ropes of the second roping such that they may touch the elevator hoistway components. In case these ropes are arranged to pass around rope wheels, they may wander laterally against the surface of the rope wheel due to said sway. Due to this, a reliable tie-down mechanism has been difficult to provide. It has been found out that one reason for the disturbances is that the rope tension of the second roping is low, for example compared to that of the hoisting roping. The tension is low especially because the second roping does not suspend the elevator car or the counterweight as the hoisting roping does.

BRIEF DESCRIPTION OF THE INVENTION

The object of the invention is to introduce an elevator where unintended lateral movement of a light-weighted roping hanging between the elevator car and the counterweight is reduced. The object of the invention is, inter alia, to solve previously described drawbacks of known solutions and problems discussed later in the description of the invention. Embodiments are presented where this object is achieved with aid of contoured shapes of the rope(s) and a rope wheel. Also, embodiments are presented, inter alia, where tension of individual ropes of the second roping is increased by one or more ways thereby ensuring adequate grip between contoured rope wheel and contoured rope.

It is brought forward a new elevator. In a preferred embodiment of the invention, the elevator comprises an elevator car and a counterweight, and a first roping between the elevator car and counterweight suspending the elevator car and the counterweight, the first roping comprising at least one rope. The elevator further comprises a second roping between the elevator car and counterweight suspended to hang from the elevator car and counterweight, the second roping comprising at least one rope, and a rope wheel arrangement, having at least one rope wheel around which said at least one rope of the second roping passes. The longitudinal force transmission capability of said at least one rope of the second roping is based essentially on non-metallic fibers, and in that said at least one rope of the second roping is a belt-like rope having at least one contoured side provided with guide rib(s) and/or guide groove(s) oriented in the longitudinal direction of the rope, said side being fitted to pass against a contoured circumference of a rope wheel of said rope wheel arrangement, said circumference being provided with guide rib(s) and/or guide groove(s) so that said contoured circumference forms a counterpart for said contoured side of the rope. The sensitivity of the rope for disturbances caused by its lightness and the belt-like form are compensated for by the lateral guidance, which guidance is achieved by the rib-groove shapes of the rope and the circumference forming counterparts for each other. This configuration brings the benefit of a light-weighted roping between the elevator car and the counterweight without disturbances causing unintended lateral movement for the roping. The rope(s) being belt-like facilitates a small bending radius without losing cross-sectional area. Thus, the longitudinal force transmission capabilities of the roping are good.

In a preferred embodiment the elevator comprises means for blocking radially directed movement of said at least one rope wheel. The blocking of the radial movement makes it possible that the rope wheel can give support for the ropes of the second roping resisting the rope loop passing around it from rising freely when a tie-down function is needed.

In a preferred embodiment said at least one rope wheel is mounted such that it can move in its radial direction at most by an amount of a certain margin of movement. The fact that radial movement is at most a certain distance provides that the rope wheel can give support for the ropes of the second roping, thus resisting the rope loop passing around it from rising freely when a tie-down function is needed.

In a preferred embodiment also the longitudinal force transmission capability of the rope(s) of the first roping is/are based essentially on non-metallic fibers. Said non-metallic fibers are preferably similar fibers, as in said fibers of the rope(s) of the first roping. For example they can both be carbon fibers. Also, it is preferable that the rope(s) of the first roping is/are belt-like. This facilitates a small bending radius without losing cross-sectional area. Thus, the longitudinal force transmission capabilities of the roping are good. When also the first roping is light-weighted, the weight distribution of the ropings is optimal, and the second roping need not provide considerable weight compensation.

In a preferred embodiment the first roping comprises rope(s) passing around a rope wheel, said rope(s) being belt-like and having a side without guide ribs or guide grooves and fitted to pass against a circumference of said rope wheel. Having a different lateral guidance (or no guidance for the first roping) for the two ropings facilitates an optimized solution for each of them. Accordingly, these very differently behaving ropings are not in this embodiment guided in the same way. Especially, the guidance of the first roping can be arranged in more simple and therefore in cheaper and more easily maintained way. Preferably, said circumference of said rope wheel is cambered. This is one simple, easy to maintain and reliable way to provide guidance for the first roping.

In a preferred embodiment the first roping comprises a higher number of ropes than the second roping, for instance such that the first roping comprises a plurality of ropes and the second roping comprises only one rope. The smaller amount of ropes in the second roping facilitates the rope tension of individual rope(s) to be adequate for the light-weighted and wide ropes of the second roping so as to ensure reliable grip between said rope wheel or the rope wheel arrangement and the rope(s) of the second roping.

In a preferred embodiment the second roping comprises only one rope. In this way, the tension of this individual rope can be maximized. In a preferred alternative for this, the first roping comprises a 5-10 ropes and the second roping comprises 2-4 ropes.

In a preferred embodiment the rope wheel arrangement is arranged to exert with said at least one rope wheel a tensioning force on the rope. Preferably, said tensioning force is from 3000 N to 30000 N, more preferably from 5000 N to 30000 N, most preferably from 10000 N to 20000 N. Preferably, said at least one rope wheel is movably mounted on the building and the rope wheel arrangement comprises a tension means, such as a tension weight, for moving said rope wheel towards rope tightening direction. Preferably, said tension weight is from 300 kg to 3000 kg, more preferably from 500 kg to 3000 kg, most preferably 1000 kg to 2000 kg and it rests on the loop formed by the second roping. When the tension is in the preferred range the lightweighted belt-like rope is most suitably tensioned so that together with the guidance with the rib-groove-structure provides most effective reduction in disturbances which tend to move the rope laterally. This is particularily the case when the number of ropes of the second roping is small.

In a preferred embodiment each of said rope(s) of the second roping comprise(s) a force transmission part or a plurality of force transmission parts for transmitting force in the longitudinal direction of the rope, which force transmission part is made of composite material, said composite material comprising non-metallic reinforcing fibers in a polymer matrix. In this way the force transmission part (and therefore also the whole rope) can be made light, yet rigid and having a high tensile strength. High tensile strength provides for that a high number of ropes is not necessary to be used in the second roping. The composite force transmitting part(s) resist bending. Therefore, the tension needs to be high makes it possible that a rope with composite force transmitting part(s) can be forced to bend against the circumference of said at least one rope wheel. In this way, adequate rope contact can be ensured. The preferable tension ranges are as described elsewhere, the most preferably range being 10000-20000 N as described.

In a preferred embodiment each of said rope(s) of the first roping comprise(s) a force transmission part or a plurality of force transmission parts for transmitting force in the longitudinal direction of the rope, which force transmission part is made of composite material, said composite material comprising non-metallic reinforcing fibers in a polymer matrix. In this way the force transmission part (and therefore also the whole rope) can be made light, yet rigid and having a high tensile strength.

In a preferred embodiment density of the aforementioned non-metallic fibers is less than 4000 kg/m3, and the tensile strength is over 1500 N/mm2, more preferably so that the density of the aforementioned fibers (f) is less than 4000 kg/m3, and the tensile strength is over 2500 N/mm2, most preferably so that the density of the aforementioned fibers is less than 3000 kg/m3, and the tensile strength is over 3000 N/mm2. Choosing the fibers to have high tensile strength and low weight enables that the ropes are light and have a good tensile strength.

In a preferred embodiment the rope(s) of the first and/or second roping do not comprise metallic fibers or wires. Preferably, the force transmission part(s) of each rope is/are essentially fully of non-metallic material.

In a preferred embodiment the rope(s) of the second roping comprise a polymer layer forming said ribs and/or grooves. Thus, the surface properties may be chosen optimally. Preferably, the rope(s) has its force transmission part(s) surrounded with said polymer layer forming said ribs and/or grooves.

In a preferred embodiment said polymer layer covers majority of the of the cross-section area of the rope.

In a preferred embodiment the aforementioned non-metallic fibers (f) comprise carbon fibers or glass fibers or polymer fibers, such as Aramid fibers or polybenzoxazole fibers or UHMWPE fibers or corresponding.

In a preferred embodiment module of elasticity (E) of the polymer matrix (M) is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life and the enablement of smaller bending radiuses.

In a preferred embodiment the lifting height of the elevator is at least 100 meters. In this context the rope systems are increasingly sensitive to disturbances. Especially in this case, the earlier mentioned preferred tension range is most effective, because in this way the resonance frequency of the light-weighted roping is set to be beneficially far away from normal building sway frequency (e.g. 0.07-0.12 Hz).

In a preferred embodiment said at least one rope wheel(s) is/are freely rotating wheel(s). Accordingly, said at least one rope wheel(s) is/are not motor-driven.

In a preferred embodiment the aforementioned non-metallic fibers of the rope(s) of second roping, and preferably also those of the ropes of the first roping, are carbon fibers. In this way the rope has high tensile strength, low weight and good resistance for heat. Especially, the high tensile strength of the rope provides for that a high number of ropes is not necessary to be used in the second roping.

In a preferred embodiment said reinforcing fibers are oriented in the lengthwise direction of the rope. Accordingly, they are non-twisted. Preferably, individual reinforcing fibers are homogeneously distributed in said polymer matrix. Preferably, said reinforcing fibers are continuous fibers extending throughout the entire length of the rope. Preferably, said reinforcing fibers are bound together as an integral force transmission part by said polymer matrix. Preferably, said reinforcing fibers are bound together as an integral force transmission part by said polymer matrix, at a manufacturing stage by immersing the reinforcing fibers in polymer matrix material. Preferably, the polymer matrix comprises epoxy, polyester, phenolic plastic or vinyl ester. Preferably, over 50% of the cross-sectional square area of the force transmission part consists of said reinforcing fiber. Preferably, the width of each said force transmission part is larger than a thickness thereof in a transverse direction of the rope. Preferably, the rope comprises a number of said force transmission parts placed adjacently in width direction of the rope.

In a preferred embodiment said load-bearing part(s) cover minority of the of the cross-section area of the rope. Thus, the ribs and/or grooves of the rope are easy to form.

In a preferred embodiment both the first and second roping are connected from one end to the elevator car and from the other end to the counterweight.

The elevator as describe anywhere above is preferably, but not necessarily, installed inside a building. The car is preferably traveling vertically. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
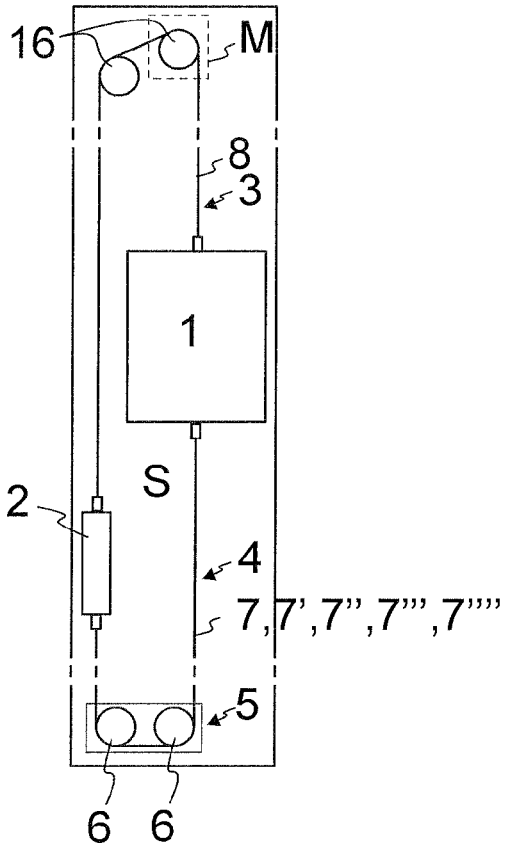
FIG. 1 illustrates schematically an elevator according to an embodiment of the invention.
Figure 2:
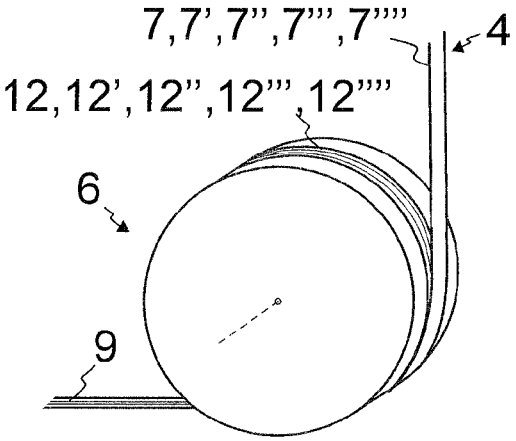
FIG. 2 illustrates the second roping passing around a rope wheel.
Figure 3:
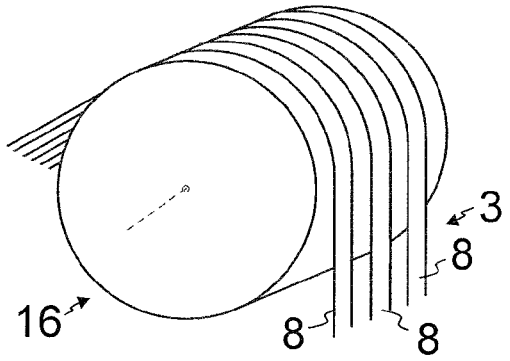
FIG. 3 illustrates the first roping passing around a rope wheel.

FIG. 1 illustrates an elevator according to a preferred embodiment. The elevator comprises elevator units, including an elevator car 1 and a counterweight 2, arranged to travel vertically in an elevator hoistway S. The elevator comprises a first roping 3 between the elevator car 1 and counterweight 2 for suspending the elevator car 1 and the counterweight 2. In the preferred embodiment the ends of the first roping 3 are fixed to the elevator car 1 and counterweight 2. Accordingly, it suspends these elevator units with 1:1 suspension ratio. The first roping 3 passes around a rope wheel 16 mounted stationary in a position above said elevator units 1 and 2. The first roping comprises at least one rope 8, but preferably plurality of ropes 8 as illustrated in FIG. 3. The elevator further comprises a second roping 4 between the elevator car 1 and counterweight 2 suspended to hang from the elevator car 1 and counterweight 2, the second roping 4 comprising at least one rope 7-7"", but preferably only one rope 7-7"" as illustrated in FIG. 2. For making the rope light, the longitudinal force transmission capability of said at least one rope 7-7"" of the second roping 4 is based essentially on non-metallic fibers f comprised in the force transmission part(s) of the rope. Said force transmission part(s) extend throughout the length of the rope, and in this case from the elevator car 1 to the counterweight 2. In particular, it is preferable that the force transmission part(s) 15 of the rope 7-7"" is/are essentially fully of non-metallic material. The rope(s) 7-7"" are lightweight and wide in structure, which makes the rope(s) 7-7"" prone to take disturbances from different phenomenon taking place in the elevator environment. To eliminate disturbances the elevator further comprises a rope wheel arrangement 5 of a special structure. The rope wheel arrangement has at least one rope wheel 6, around which said at least one rope 7-7"" of the second roping 4 passes. This rope wheel arrangement 5 is mounted below said elevator units, preferably at the bottom parts of the hoistway S. The rope wheel arrangement 5 can take support from its mounting base so as to be able to provide guidance for the at least one rope 7-7"" of the second roping 4. Said at least one rope 7-7"" of the second roping 4 is a belt-like rope 7 having at least one contoured side 9 provided with guide rib(s) 10 and/or guide groove(s) 11 oriented in the longitudinal direction of the rope 7-7"", said contoured side 9 being fitted to pass against a contoured circumference 12-12"" of a rope wheel 6 of said rope wheel arrangement 5. Said circumference 12-12"" is provided with guide rib(s) 14 and/or guide groove(s) 13 so that said contoured circumference 12-12"" forms a counterpart for said contoured side 9 of the rope 7-7"". Then the rib(s) 10 of the rope 7-7"" extend into the groove(s) 13 of the contoured circumference 12-12"" and the rib(s) 14 of the contoured circumference 12-12"" extend into the groove(s) 11 of the rope 7-7"". The matching guide rib(s) and the guide groove(s) between the contoured circumference 12-12"" and the contoured side 9 of the rope 7-7"" define the lateral position of the rope 7-7"" relative to the contoured circumference 8. As a result, the rope wheel arrangement 5 can efficiently provide lateral guidance for the rope 7-7"" of the second roping 4. Said guide rib(s) 14 and/or guide groove(s) 13 extend in a ring-like way on the plane of rotation of the rope wheel 16.

Figure 4:
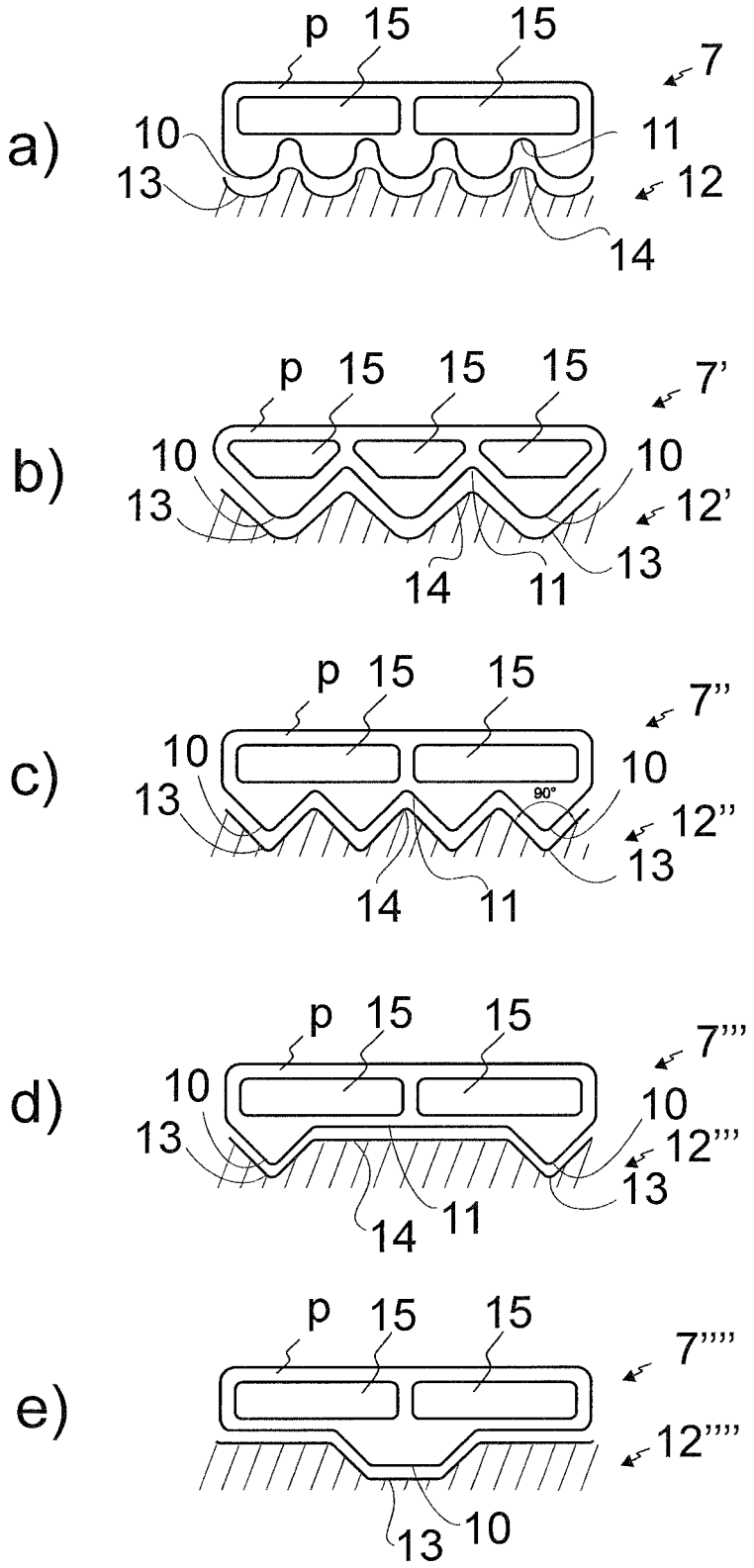
FIGS. 4*a* to 4*e* illustrate preferred alternative structures of the rope of the second roping and the rope wheel forming its counterpart.
Figure 5:
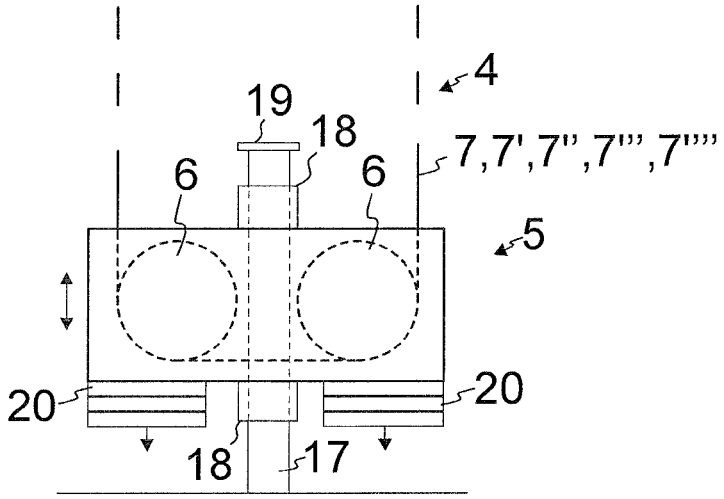
FIG. 5 illustrates a preferred rope wheel arrangement.

Said at least one rope wheel 6, around which said at least one rope 7-7"" of the second roping 4 passes is preferably mounted to be movable in its radial direction. The rope wheel arrangement 5 is arranged to exert a tensioning force on the rope 7 with the rope wheel. Said movability can be arranged e.g. by mounting said at least one rope wheel 6 on the rope wheel arrangement 5 movably or mounting the rope wheel arrangement 5 movably on its mounting position. The latter option is illustrated in FIG. 4. In any case, it is preferable that the rope wheel arrangement 5 comprises a tension means, such as a tension weight 20 illustrated in FIG. 5, for moving said rope wheel 6 towards rope tightening direction. In the embodiment as illustrated in FIG. 5 the overall weight of said tension weight 20 is from 300 kg to 3000 kg, more preferably from 500 to 3000 kg, most preferably from 1000 kg to 2000 kg, and it rests on the loop formed by the second roping 4. In this way, the tension means can provide an overall tensioning force of 2000 N-30000 N (with said 300-3000 kg), or even the more preferable 5000 N-30000 N (with said 500-3000 kg) most preferably 10000-20000 N (with said 1000-2000 kg). Said ranges of tension are specifically suitable for elevators having lifting height of 100 meters of higher. Tension force range as specified is suitable for ensuring that the light-weighted and wide rope 7-7"" stays in all situations in sufficient contact with said rope wheel(s) 6 and thus under influence and guidance of the contoured circumference 12-12"". A specifically beneficial combination is achieved when the lifting height is 300-500 m and the overall tensioning force produced by the tension means is 10000 N-20000 N.

As illustrated in FIGS. 2 and 3, it is preferable that the first roping 3 comprises a higher number of ropes 8 than the second roping 4. The first roping 3 may comprise a plurality of ropes 8, such as three (or possibly even greater number) and the second roping 4 comprises only one rope 7-7"". In this way the higher load to be beared can be divided for a great number of ropes of the first roping 3 whereas the small load to be beared can be achieved in the second roping 4 with merely one rope 7-7"". In this way, the first roping 3 can have a large contact area with the rope wheel 16 around which it turns. Accordingly, this rope wheel 16 may transmit great forces, such as forces for breaking or accelerating the car 1 and counterweight. Also, in this way, the individual ropes of the first and second roping can be kept at least roughly in the same scale. This may be relevant for instance for the turning radius of the individual ropes. Also, in this way, the individual ropes of the first and second roping can be manufactured with same process, such as a process for making a light-weighted rope. As the individual ropes of the first and second roping 3,4 are preferably light-weighted, e.g. being based on non-metallic fibers, the second roping 4 need not be similar in weight as the first roping 3. This is because the unbalance caused by the first roping 3 is in non-problematic range when considered proportionally with the weights of the car 1 and the counterweight. In particular, the traction between the hoisting machinery and the first roping 3 can be kept adequate also when the car 1 is in its extreme position. The hoisting machinery preferably comprises a motor M arranged to move the first roping. Preferably this motor M rotates a rope wheel 16 around which the ropes 8 of the first roping 3 pass.

FIGS. 4*a*-4*e* each presents an embodiment of the rope 7-7"" of the second roping 4 and the circumference 12-12"" of a rope wheel 6 of said rope wheel arrangement 5 against which the rope 7-7"" is fitted to pass. In each case the rope 7-7"" comprises a force transmission part 15 or a plurality of force transmission parts 15, for transmitting force in the longitudinal direction of the rope 7-7"". The preferred structure for the force transmission part(s) 15 is disclosed elsewhere in this application. Said force transmission part 15 or said plurality of force transmission parts 15 is/are surrounded with a layer p, which is preferably of polymer, most preferably of polyurethane, which layer p forms the surface of the rope 7-7"". In each Figure, the rope 7-7"" is belt-like and has a contoured side 9 facing sideways with respect to the longitudinal direction of the rope 7-7"". The contoured side 9 is provided with guide rib(s) 10 and/or guide groove(s) 11 oriented in the longitudinal direction of the rope 7-7"", said side 9 being fitted to pass against a contoured circumference 12-12"" of a rope wheel 6 of said rope wheel arrangement 5, said circumference 12-12"" being provided with guide rib(s) 14 and/or guide groove(s) 13 so that said contoured circumference 12-12"" forms a counterpart for said contoured side 9 of the rope 7-7"". The layer p forms said ribs 10,14 and/or grooves 11,13. Each groove 11,13 and each rib 10,14 has opposite side faces facing the width direction of the rope (preferably in an angle inclined towards the side where the counterpart is located). The side faces of the ribs 10,14 are fitted between side faces of the grooves 11,13.

In FIGS. 4*a*-4*d* the rope 7-7''' comprises plurality of ribs 10 and the circumference 12-12''' comprises plurality of grooves 13 into which the ribs 10 of the rope 7-7''' extend. Between ribs 10, which are adjacent to each other, the rope 7-7''' has a groove 11 into which a rib 14 of the circumference 12-12''' extends. Correspondingly, this rib 14 of the circumference 12-12''' is formed between grooves 13, which are adjacent to each other, of the circumference 12-12'''. In FIG. 4*e* the rope 7"" comprises only one rib 10 and the circumference 12"" comprises a groove 13 into which the rib 10 of the rope 7"" extends.

The rope 7-7"" is arranged to transmit the longitudinal force of the rope between the elevator car 1 and the counterweight 2 with the aforementioned force transmission part(s) 15. Thus, it can be used for slowing down the upward movement of the counterweight 2 in emergency braking of the downward movement of the elevator car 1 and vice versa. In this way continuation of the said movement can be prevented e.g. in a situation in which the speed of the elevator car 1 is decelerated quickly, with an acceleration of even 1 G or faster.

As illustrated in configuration of FIG. 5, said at least one rope wheel 6, around which said at least one rope 7-7"" of the second roping 4 passes is preferable mounted to be movable in its radial direction. It is not absolutely necessary, though, that the rope wheel 6 is movable. In any case, it is preferred that said at least one rope wheel 6 is mounted (relative to the building) such that it can move in its radial direction at most by an amount of a certain margin of movement. In this way it can reliably give support for the ropes 7-7"" of the second roping resisting the rope loop passing around it from moving freely when a tie-down function is needed. In FIG. 5 the arrangement 5 comprises two rope wheels but the arrangement 5 could alternatively be constructed with only one rope wheel. Said at least one rope wheel(s) 6 is/are freely rotating wheel(s). The tension weight 20 is in FIG. 20 divided into two parts each forming part of the weight of the tension weight. In overall, their weight is preferably said 300 kg-3 000 kg (or said 500-30000 kg or 1000-2 000 kg) as specified earlier thus providing a tensioning force 2000-30000 N (or said 5000 N-30000 N, or said 10000-20000 N). The tensioning force produced by the tensioning weights is illustrated with arrows. The movement of the rope wheel 6 is provided by mounting the arrangement 5 movably on its mounting position. The movement of the rope wheel arrangement 5 is preferably guided with guide means 17, 18, 19. These guide means 17,18, 19 comprise in the preferred embodiment a guide rail 17 via which the rope wheel arrangement 5 is mounted on the building and a guide 18 moving vertically and guided by the guide rail 17 and forming part of the rope wheel arrangement 5. The guide 18 is preferably fixed to the frame structure of the rope wheel. The guide means 17, 18, 19 also comprise a means 19 for blocking, preferably a stopper as illustrated, the radially directed movement of the rope wheel 6. This blocking means 19, in case of FIG. 5, forms a limit for the aforementioned margin of movement of the rope wheel 6. The blocking could alternatively be permanent (the rope wheel then being mounted to rotate in a fixed position), but preferably said at least one rope wheel 6 is mounted such that it can move in its radial direction at most by the amount of said certain margin of movement, after which the blocking is realized. The blocking of the radial movement makes it possible that the rope wheel can give support for the ropes of the second roping, thus resisting the rope loop passing around it from rising freely when a tie-down function is needed. Preferably the rope wheel arrangement 5, and thereby also the rope wheel 6, is mounted in the elevator hoistway, for example in the lower end thereof. In addition or alternatively, said movement of the rope wheel 6 could be blocked selectively when the speed of the aforementioned movement exceeds a certain limit, the speed then indicating a need for tie-down. For this purpose, the rope wheel arrangement could be provided with a hydraulic system controlling its movement and blocking the rope wheel movement when the speed of the movement exceeds a certain limit. This could be achieved for instance with a flow fuse valve through which a fluid is arranged to flow in accordance with movement of the rope wheel 6 which valve is arranged to disconnect the flow when the flow velocity exceeds a certain limit. This type of system is presented for instance in FIG. 6 of Said force transmission part(s) 15 is/are preferably of a material, which comprises non-metallic fibers f oriented at least essentially longitudinal to the rope. These fibers f are preferably chose such that the density of said fibers f is less than 4000 kg/m3, and the tensile strength is over 1500 N/mm2, more preferably so that the density of the aforementioned fibers (f) is less than 4000 kg/m3, and the tensile strength is over 2500 N/mm2, most preferably so that the density of the aforementioned fibers (f) is less than 3000 kg/m3, and the tensile strength is over 3000 N/mm2. In particular, said non-metallic fibers are preferably carbon fibers, glass fibers or polymer fibers, such as Aramid fibers or polybenzoxazole fibers or UHMWPE fibers or corresponding, which are all light fibers. The material of the force transmission part is in this case most preferably formed to be a composite material, which comprises the aforementioned non-metallic fibers f as reinforcing fibers in a polymer matrix m. Thus the force transmission part 15 is light, rigid in the longitudinal direction and when it is belt-shaped it can, however, be bent with a small bending radius. Especially preferably the fibers f are carbon fibers. They possess good strength properties and rigidity properties and at the same time they still tolerate very high temperatures, which is important in elevators because poor heat tolerance of the hoisting ropes might cause damage or even ignition of the hoisting ropes, which is a safety risk. Good thermal conductivity also assists the onward transfer of heat due to friction, among other things, and thus reduces the accumulation of heat in the parts of the rope. More particularly the properties of carbon fiber are advantageous in elevator use. The advantageous properties of said fibers f and this type of force transmission parts as well as manufacturing methods thereof are also described in publication WO2009090299A1.

As presented in the figures, the rope 7-7"" of the elevator according to the invention is most preferably belt-shaped. Its width/thickness ratio is preferably at least 2 or more, preferably at least 4, even more preferably at least 5 or more, yet even more preferably at least 6, yet even more preferably at least 7 or more, yet even more preferably at least 8 or more, most preferably of all more than 10. In this way a large cross-sectional area for the rope is achieved, the bending capacity of the thickness direction of which is good around the axis of the width direction also with rigid materials of the force transmission part. Additionally, preferably the aforementioned force transmission part 2 or a plurality of force transmission parts 2 together cover most of the width of the cross-section of the rope for essentially the whole length of the rope. Thus the supporting capacity of the rope with respect to its total lateral dimensions is good, and the rope does not need to be formed to be thick. This can be simply implemented with any of the aforementioned materials, with which the thinness of the rope is particularly advantageous from the standpoint of, among other things, service life and bending rigidity. The rope 7-7"" can comprise one force transmission part 15 of the aforementioned type, or a plurality of them, in which case this plurality of force transmission parts 15 is formed from a plurality of parallel force transmission parts 15 placed on essentially the same plane. Thus the resistance to bending in their thickness direction is small. Preferably, the force transmission part(s) 15 have/has width greater than the thickness. In this case preferably such that the width/thickness of the force transmission part 2 is at least 2 or more, preferably at least 3 or more, even more preferably at least 4 or more, yet even more preferably at least 5, most preferably of all more than 5. In this way a large cross-sectional area for the force transmission part/parts is achieved, the bending capacity of the thickness direction of which is good around the axis of the width direction also with rigid materials of the force transmission part.

For facilitating the formation of the force transmission part 15 and for achieving constant properties in the longitudinal direction it is preferred that the structure of the force transmission part 15 continues essentially the same for the whole length of the rope. For the same reasons, the structure of the rope continues preferably essentially the same for the whole length of the rope.

Figure 6:
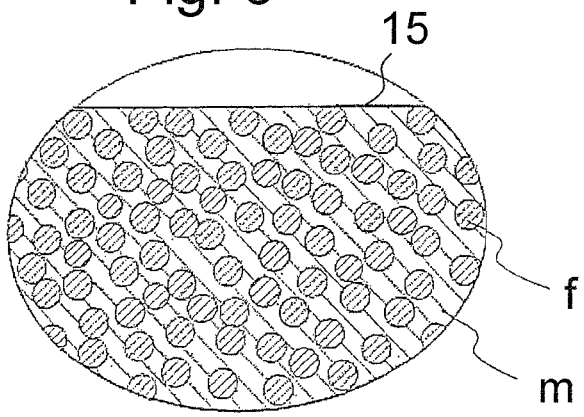
FIG. 6 illustrates a preferred internal structure for the force transmission part.

The force transmission part 15 or the aforementioned plurality of force transmission parts 15 of the rope 7-7"" is/are preferably fully of non-metallic material. Thus the rope 7-7"" is light. The force transmission part 15 is more precisely made of non-metallic composite, which comprises non-metallic reinforcing fibers f in a polymer matrix m. The part 15 with its fibers is longitudinal to the rope, for which reason the rope retains its structure when bending. Individual fibers are thus oriented in essentially the longitudinal direction of the rope. In this case the fibers are aligned with the force when the rope is pulled. Said reinforcing fibers f are bound into a uniform force transmission part with the polymer matrix m. Thus, the force transmission part 15 is one solid elongated rodlike piece. The reinforcing fibers f are preferably long continuous fibers in the longitudinal direction of the rope 7-7"", and the fibers f preferably continue for the distance of the whole length of the rope. Preferably as many fibers f as possible, most preferably essentially all the fibers f of the force transmission part 15 are oriented in longitudinal direction of the rope. The reinforcing fibers f are in this case essentially untwisted in relation to each other. Thus the structure of the force transmission part can be made to continue the same as far as possible in terms of its cross-section for the whole length of the rope. The reinforcing fibers f are preferably distributed in the aforementioned force transmission part 15 as evenly as possible, so that the force transmission part would be as homogeneous as possible in the transverse direction of the rope. The bending direction of the rope is preferably around an axis that is in the width direction of the rope (up or down in the figure). An advantage of the structure presented is that the matrix m surrounding the reinforcing fibers f keeps the interpositioning of the reinforcing fibers essentially unchanged. It equalizes with its slight elasticity the distribution of a force exerted on the fibers, reduces fiber-fiber contacts and internal wear of the rope, thus improving the service life of the rope. The reinforcing fibers can be glass fibers, in which case good electrical insulation and an inexpensive price, among other things, are achieved. Alternatively the reinforcing fibers can be carbon fibers, in which case good tensile rigidity and a light structure and good thermal properties, among other things, are achieved. In this case also the tensile rigidity of the rope is slightly lower, so that traction sheaves of small diameter can be used. The composite matrix, into which the individual fibers are distributed as evenly as possible, is most preferably of epoxy resin, which has good adhesiveness to the reinforcements and which is strong to behave advantageously at least with glass fiber and carbon fiber. Alternatively, e.g. polyester or vinyl ester can be used. FIG. 6 presents a preferred internal structure for a force transmission part 15. A partial cross-section of the surface structure of the force transmission part (as viewed in the longitudinal direction of the rope) is presented inside the circle in the figure, according to which cross-section the reinforcing fibers f of the force transmission parts 15 presented elsewhere in this application are preferably in a polymer matrix m. FIG. 6 presents how the individual reinforcing fibers f are essentially evenly distributed in the polymer matrix m, which surrounds the fibers and which is fixed to the fibers. The polymer matrix m fills the areas between individual reinforcing fibers f and binds essentially all the reinforcing fibers f that are inside the matrix m to each other as a uniform solid substance. In this case abrasive movement between the reinforcing fibers F and abrasive movement between the reinforcing fibers F and the matrix M are essentially prevented. A chemical bond exists between, preferably all, the individual reinforcing fibers F and the matrix M, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by embedding them together in the molten material of the polymer matrix. In this case the gaps of individual reinforcing fibers bound to each other with the polymer matrix comprise the polymer of the matrix. Thus in the invention preferably a large amount of reinforcing fibers bound to each other in the longitudinal direction of the rope are distributed in the polymer matrix. The reinforcing fibers are preferably distributed essentially evenly in the polymer matrix such that the force transmission part is as homogeneous as possible when viewed in the direction of the cross-section of the rope. In other words, the fiber density in the cross-section of the force transmission part does not therefore vary greatly. The reinforcing fibers f together with the matrix m form a uniform force transmission part, inside which abrasive relative movement does not occur when the rope is bent. The individual reinforcing fibers of the force transmission part are mainly surrounded with polymer matrix m, but fiber-fiber contacts can occur in places because controlling the position of the fibers in relation to each other in their simultaneous impregnation with polymer is difficult, and on the other hand, totally perfect elimination of random fiber-fiber contacts is not wholly necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the force transmission part can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the force transmission part 15 such that the gaps of individual reinforcing fibers f are filled with the polymer of the matrix m. Most preferably the majority, preferably essentially all of the gaps of the individual reinforcing fibers f in the force transmission part are filled with the polymer of the matrix. The matrix m of the force transmission part 15 is most preferably hard in its material properties. A hard matrix m helps to support the reinforcing fibers f, especially when the rope bends, preventing buckling of the reinforcing fibers f of the bent rope, because the hard material supports the fibers f. To reduce the bending radius of the rope, among other things, it is therefore preferred that the polymer matrix is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the force transmission part is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix. Most preferably such that approx. 60% of the surface area is of reinforcing fiber and approx. 40% is of matrix material (preferably epoxy). In this way a good longitudinal strength of the rope is achieved. In this application, the term force transmission part refers to the part that is elongated in the longitudinal direction of the rope, and which part is able to bear without breaking a significant part of the load exerted on the rope in question in the longitudinal direction of the rope. The aforementioned load causes tension on the force transmission part in the longitudinal direction of the rope, which tension can be transmitted between the elevator car 1 and counterweight 2 in the longitudinal direction of the rope inside the force transmission part in question. Accordingly, the force transmission part(s) 15 of the rope(s) 7-7"" can be used for providing tie-down function (i.e. restrict the elevator car from continuing its upwards directed movement movement (jumping) in case the counterweight suddenly stops, and vice versa), and for this purpose particularly for transmitting force all the way from the counterweight to the elevator car, or vice versa. Correspondingly, also the force transmission part(s) 15 of the rope(s) 8 can be used for transmitting force all the way from the counterweight to the elevator car and thus for suspending the counterweight and the elevator car.

Figure 7:
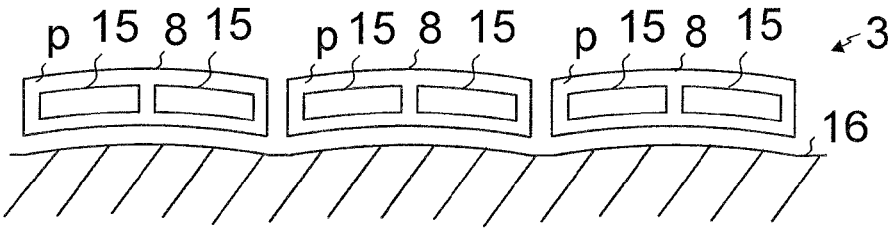
FIG. 7 illustrates a preferred structure of the rope of the first roping and the rope wheel forming its counterpart.

It is preferable that each of said rope(s) 8 of the first roping 3 comprise(s) a force transmission part 15 or a plurality of force transmission parts 15 for transmitting force in the longitudinal direction of the rope 8, which force transmission part 15 is made of composite material, said composite material comprising non-metallic reinforcing fibers f in a polymer matrix m. The force transmission part(s) 15 of the ropes are preferably as defined earlier for the rope 7-7"". The ropes 8 may be also otherwise structurally as defined earlier for the rope 7-7"". Accordingly, for instance the width/thickness ratio of the rope 8 is preferably at least 2 or more, preferably at least 4, even more preferably at least 5 or more, yet even more preferably at least 6, yet even more preferably at least 7 or more, yet even more preferably at least 8 or more, most preferably of all more than 10. However, it is not necessary that these ropes 8 are contoured as the ropes 7-7"". The first roping 3 may comprises rope(s) 8 passing around a rope wheel 16, said rope(s) 8 being belt-like and having a a side without guide ribs or guide grooves and fitted to pass against a circumference of said rope wheel 16. FIG. 7 illustrates a preferred structure of the rope 8 of the first roping 3 and the rope wheel 16 forming its counterpart. In this case the circumference of said rope wheel 16 is cambered. The cambered shape can provide lateral guidance for the rope 8. The tension of the ropes 8 of the first roping 3 is high due to the fact that is suspending the car 1 and counterweight. This enables reliable utilization of the cambered shape for guidance of the ropes 8 of the first roping 3.

The embodiments above disclose preferred number of force transmission part(s) 15. The specific number or the force transmission part(s) in each of the ropes 7-7"", 8 could, however, be other than what is described. For instance each rope 7-7"", 8 could comprise only one or even 3-5 of said force transmission part(s) 15. The embodiments above disclose preferred number of ropes for the first and second roping. The specific number or the ropes in each of the ropings could, however, be other than what is described. For example one or both of the ropings could comprise more ropes than what is shown. The first roping 3 could comprise a higher number of ropes 8 than the second roping 4, for example such that the first roping 3 comprises at least five ropes 8 and the second roping 4 comprises less than five ropes 7-7"". A suitable alternative combination would be for instance that the second roping 4 comprises 2, 3 or 4 ropes 7-7"" and the first roping 3 comprises from five to ten ropes 8.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

an elevator car and a counterweight;

a first roping between the elevator car and counterweight suspending the elevator car and the counterweight and comprising at least one rope;

a motor arranged to move the first roping, the motor disposed above the elevator car and the counterweight;

a second roping between the elevator car and counterweight suspended to hang from the elevator car and counterweight and comprising at least one rope; and a rope wheel arrangement, having at least one rope wheel, around which said at least one rope of the second roping passes, wherein a longitudinal force transmission capability of said at least one rope of the second roping is based substantially on non-metallic fibers, and in that said at least one rope of the second roping is a belt shaped rope having at least one contoured side provided with guide ribs and/or guide grooves oriented in the longitudinal direction of the rope, said side being fitted to pass against a contoured circumference of a rope wheel of said rope wheel arrangement, said circumference being provided with guide ribs and/or guide grooves so that said contoured circumference forms a counterpart for said contoured side of the rope, each of said ropes of the second roping comprising a force transmission part or a plurality of force transmission parts for transmitting force in a longitudinal direction of the rope, which force transmission part is made of composite material, said composite material comprising non-metallic reinforcing fibers in a polymer matrix, and in that the rope wheel arrangement is arranged to exert with said at least one rope wheel a tensioning force on the rope, wherein the non-metallic reinforcing fibers are oriented at least essentially in a lengthwise direction of the second roping, wherein the first roping comprises a higher number of ropes than the second roping, and wherein the non-metallic fibers comprise carbon fibers or glass fibers, wherein the rope wheel arrangement comprises guide that is fixed to a frame structure of said at least one rope wheel, wherein the rope wheel arrangement is mounted to only one guide rail via said guide, and wherein said guide rail comprises a stopper at an end thereof configured to limit the upward movement of the at least one rope wheel.

2. The elevator according to claim 1, wherein the ropes of the first roping is/are belt shaped and the longitudinal force transmission capability of the ropes of the first roping is/are based essentially on non-metallic fibers.

3. The elevator according to claim 2, wherein the first roping comprises ropes passing around a rope wheel, said ropes being belt shaped and having a side without guide ribs or guide grooves and fitted to pass against a circumference of said rope wheel.

4. The elevator according to claim 3, wherein said circumference of said rope wheel is cambered.

5. The elevator according to claim 1, wherein said at least one rope wheel is mounted such that it can move in its radial direction to perform a tie-down function while the at least one rope wheel does not turn.

6. The elevator according to claim 5, wherein the ropes of the first roping is/are belt shaped and the longitudinal force transmission capability of the ropes of the first roping is/are based essentially on non-metallic reinforcing fibers.

7. The elevator according to claim 1, wherein the second roping comprises only one rope.

8. The elevator according to claim 1, wherein said tensioning force is from 3000 N to 30000 N.

9. The elevator according to claim 1, wherein the ropes of the second roping comprise a polymer layer forming said ribs and/or grooves.

10. The elevator according to claim 1, wherein each of said ropes of the first roping comprises a force transmission part or a plurality of force transmission parts for transmitting force in the longitudinal direction of the rope, which force transmission part is made of composite material, said composite material comprising non-metallic reinforcing fibers in a polymer matrix.

11. The elevator according to claim 1, wherein a density of the non-metallic reinforcing fibers is less than 4000 kg/m3, and a tensile strength is over 1500 N/mm2.

12. The elevator according to claim 1, wherein the lifting height of the elevator is at least 100 meters.

13. The elevator according to claim 1, wherein the non-metallic reinforcing fibers are essentially untwisted in relation to each other.

14. The elevator according to claim 1, wherein the width of each said force transmission part is larger than a thickness thereof in a transverse direction of the rope.

15. The elevator according to claim 1, wherein the at least one rope wheel of the rope wheel arrangement is not motor driven.

16. The elevator according to claim 1, wherein the non-metallic reinforcing fibers are polymer fibers, including one of Aramid fibers, polybenzoxazole fibers or UHMWPE fibers.

* * * * *